US007832384B2

(12) United States Patent
Bleffert

(10) Patent No.: US 7,832,384 B2
(45) Date of Patent: Nov. 16, 2010

(54) EXHAUST-GAS RECIRCULATION IN AN AIR-COOLED INTERNAL COMBUSTION ENGINE

(75) Inventor: Alfons Bleffert, Cologne (DE)

(73) Assignee: DUETZ Aktiengesellschaft, Koeln (DE)

( * ) Notice: Subject to any disclaimer, the term of this patent is extended or adjusted under 35 U.S.C. 154(b) by 207 days.

(21) Appl. No.: 12/084,491

(22) PCT Filed: Dec. 1, 2006

(86) PCT No.: PCT/EP2006/011545

§ 371 (c)(1),
(2), (4) Date: May 2, 2008

(87) PCT Pub. No.: WO2007/065601

PCT Pub. Date: Jun. 14, 2007

(65) Prior Publication Data

US 2009/0139501 A1 Jun. 4, 2009

(30) Foreign Application Priority Data

Dec. 8, 2005 (DE) ..... 10 2005 059 007

(51) Int. Cl.
*F02M 25/07* (2006.01)
*F02B 47/08* (2006.01)

(52) U.S. Cl. ..... 123/568.13; 123/568.12

(58) Field of Classification Search ..... 123/58.8, 123/568.11–568.13, 568.2
See application file for complete search history.

(56) References Cited

U.S. PATENT DOCUMENTS 4,109,625 A * 8/1978 Kawamura et al. ..... 123/568.13
4,119,071 A 10/1978 Hattori ..... 123/568.13
4,271,810 A * 6/1981 Lancaster ..... 123/568.13
4,292,944 A 10/1981 Matsumoto ..... 123/432
4,643,157 A 2/1987 Nishikawa et al. ..... 123/568.13
6,386,154 B1 * 5/2002 Hellman et al. ..... 123/568.13
6,688,293 B2 * 2/2004 Urushihara et al. .... 123/568.13
6,868,842 B2 * 3/2005 Strawbridge ..... 123/568.13

FOREIGN PATENT DOCUMENTS

| | | |
|---|---|---|
| DE | 29 39 708 | 4/1981 |
| DE | 103 60 092 | 7/2005 |
| EP | 0 565 410 | 10/1993 |
| FR | 28 40 363 | 12/2003 |

* cited by examiner

*Primary Examiner*—Willis R Wolfe, Jr.
(74) *Attorney, Agent, or Firm*—Davidson, Davidson & Kappel, LLC

(57) ABSTRACT

An internal combustion engine includes a crankcase and a cylinder head which covers a cylinder of the crankcase and in which a fresh-gas channel and an exhaust-gas channel are made which open on a cylinder-head longitudinal side and are connected to in each case a fresh-gas line and an exhaust-gas collection line, and wherein there is an exhaust-gas recirculation system, including an exhaust-gas recirculation line and a control valve. An internal combustion engine having an exhaust-gas recirculation system is provided, in which the exhaust-gas recirculation system remains uninfluenced by the exhaust-gas collection line which is hot during operation. This is achieved in that the exhaust-gas recirculation system is arranged on that cylinder-head side which lies opposite the fresh-gas line and the exhaust-gas collection line. This arrangement away from the exhaust-gas collection line which is substantially hotter than other components during operation has the consequence of a direct reduction of the temperature of the recirculated exhaust-gas amount, without further special cooling measures being provided.

5 Claims, 2 Drawing Sheets

EXHAUST-GAS RECIRCULATION IN AN AIR-COOLED INTERNAL COMBUSTION ENGINE

This application is a national phase of International Application No. PCT/EP2006/011545, filed Dec. 1, 2006, which claims priority to DE 10 2005 059 007.1, filed Dec. 8, 2005.

The present invention relates to an internal combustion engine having a crankcase and a cylinder head which covers a cylinder of the crankcase and which has a fresh-gas channel and an exhaust-gas channel recessed therein that open out on a longitudinal side of the cylinder head and that communicate with a fresh-gas line and an exhaust manifold, respectively, an exhaust-gas recirculation system, which includes an exhaust-gas recirculation line and a control valve, being provided.

BACKGROUND

An internal combustion engine of this kind is known from DE 693 00 649 T2. This internal combustion engine has a cylinder head in the case of which the fresh-gas channels and the exhaust-gas channels of the individual cylinders lead out on a longitudinal side of the cylinder head that is formed as a cylinder-head block. The exhaust manifold has a special connection for attaching the exhaust-gas recirculation system, in particular a control valve for controlling the recirculated exhaust volume. To introduce the exhaust gas, that is to be recirculated, into the fresh-gas channels, a special component referred to as a ramp is used between these channels and the fresh-gas manifold. This design has the inherent disadvantage that insertion of the ramp necessitates modifying the exhaust manifold and increasing the overall height of the internal combustion engine. Moreover, the control valve, in particular, projects beyond the given lateral contour of the internal combustion engine. A cooling of the recirculated exhaust gas is not provided and is made more difficult by the immediate proximity to the exhaust manifold that is hot during operation.

An object of the present invention is to devise an internal combustion engine having an exhaust-gas recirculation system that will remain unaffected by the exhaust manifold that is hot during operation.

The present invention provides a exhaust-gas recirculation system is located on the cylinder head side opposite the fresh-gas line and the exhaust manifold. This configuration at a distance from the exhaust manifold, which is substantially hotter than other components during operation, has the effect of directly lowering the temperature of the recirculated exhaust volume, without the need for other special cooling measures. The cylinder head is preferably an individual cylinder head, which is bolted, together with the corresponding cylinder, to the crankcase. As a matter of course, the present invention may also be generally used for a block cylinder head and for cylinders that are fabricated in one piece together with the crankcase.

In a further refinement of the present invention, channels which open out on the cylinder head side and communicate with the fresh-gas channel and the exhaust-gas channel, respectively, are recessed in the cylinder head (the fresh-gas channel and the exhaust-gas channel connect gas-exchange valves in the cylinder head to the fresh-gas line and, respectively, to the exhaust manifold). The channels, whose cross section may be dimensioned to be substantially smaller than the aforementioned gas channels, may be configured at an appropriate location in the cylinder head and be included as integrally cast channels during manufacture of the cylinder head or be subsequently introduced in a mechanical machining process. These channels are preferably introduced into the cylinder head in a subsequent mechanical machining process, making it possible for the design of the cylinder head blank to be identical for internal combustion engine versions which are equipped with exhaust gas recirculation and for those that are not. An exhaust-gas recirculation system, which includes an exhaust-gas recirculation manifold, an exhaust-gas recirculation control valve and an exhaust-gas-recirculation distribution line, may then be readily mounted at these channels which open out on the cylinder head side. In this context, a further advantage is derived in that the exhaust manifold may remain unchanged as compared to a design without exhaust-gas recirculation. This is particularly advantageous when different types of exhaust manifolds having different connections for directing the exhaust gases, for example, are provided for various application purposes and customer requirements. In addition, the construction volume of the internal combustion engine that is relevant for an installation is not affected by this design and arrangement of the exhaust-gas recirculation system, so that the need is eliminated for distinguishing between an internal combustion engine equipped with exhaust-gas recirculation and one that is not. This is especially advantageous in terms of the interchangeability of equivalent internal combustion engines that are installed in construction machinery or agricultural machines.

In a further refinement of the present invention, the internal combustion engine has a cooling-air blower, and the exhaust-gas recirculation system is configured directly in the cooling-air flow supplied by the cooling-air blower, within a cooling-air duct housing. In the first place, this arrangement allows the recirculated exhaust gas to be effectively cooled without requiring any further outlay. In addition, the exhaust-gas recirculation system may be integrated in a cooling-air duct which is formed from a cooling-air duct housing and is configured along the cylinder head side and thus, in any case, does not constitute a component that projects beyond a given lateral contour, thereby ensuring that an internal combustion engine correspondingly equipped with an exhaust-gas recirculation system is readily interchangeable with an identical internal combustion engine that is not equipped with an exhaust-gas recirculation system. An internal combustion engine of this kind is preferably an air-cooled internal combustion engine. However, it may also be an internal combustion engine having a combination cooling system, the blower cooling the cooling medium, for example oil and/or water and, if indicated, being additionally utilized for air cooling the cylinder head and/or a heat exchanger, for example.

In a further embodiment, the exhaust-gas recirculation control valve is disposed adjacently to the cooling-air blower, thereby providing a particularly effective and intensive cooling of this thermally sensitive component. Finally, to enhance the cooling capacity, the exhaust-gas recirculation system may, in particular, have an outer ribbing, particularly with regard to optimized fluid mechanics, it being possible for this outer ribbing to be oriented in the direction of the cooling-air flow.

Other advantageous embodiments of the present invention may be inferred from the description of the drawings, in which an exemplary embodiment of the present invention illustrated in the figures is described in greater detail.

Figure 1:
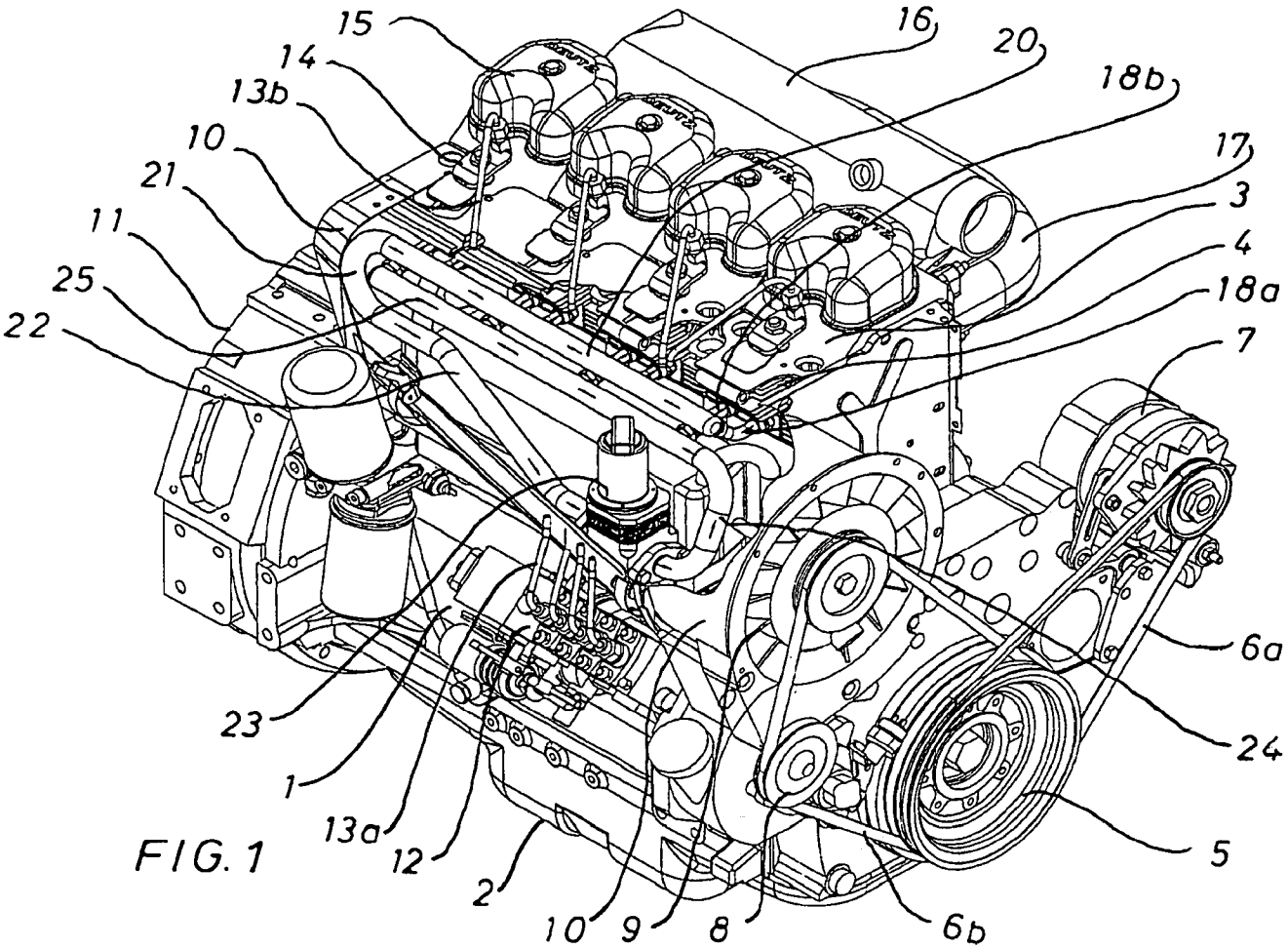
FIG. 1 shows a perspective view of an internal combustion engine having an open cooling-air duct housing.

The internal combustion engine in accordance with FIG. 1 has a crankcase 1, which is sealed at the bottom by an oil pan 2. Attached to crankcase 1 in a configuration facing opposite oil pan 2 are cylindrical pipes which are covered, in turn, by cylinder heads 3. The exemplary embodiment refers to a four-cylinder internal combustion engine, so that, altogether, four cylindrical pipes and four cylinder heads 3 are installed. Moreover, the internal combustion engine is air-cooled and, accordingly, the cylinder pipes and cylinder heads 3 are provided with cooling ribs 4.

Fastened at the front end of the internal combustion engine to a crankshaft supported in crankcase 1 is a double-belt pulley 5 which is operatively connected via a first V-belt 6*a* to a generator 7 and via a second V-belt 16*b* to a cooling-air blower 9, a tensioning roller 8 being interposed therebetween.

Cooling-air blower 9 is configured laterally above crankcase 1, essentially in the area next to the cylinder pipes and cylinder heads 3, and delivers cooling air drawn in from the ambient environment into a cooling-air duct housing 10, which extends from cooling-air blower 9 to an opposite output end 11 of the internal combustion engine and distributes the delivered cooling air across the internal combustion engine along the cylinder pipes and cylinder heads 3. In FIG. 1, a maintenance lid of cooling-air duct housing 10 is removed, and cooling-air duct housing 10 is shown in a partial cut-way view in the region of cooling-air blower 9, revealing the interior of cooling-air duct housing 10.

Mounted below cooling-air duct housing 10 is an in-line injection pump 12, which communicates via injection lines 13*a*, 13*b* (shown in an interrupted view) with fuel injectors installed in cylinder heads 3. Each fuel injector is secured by clamping claws 14 to the cylinder head and is laterally contiguous to a valve cover 15 which extends to a cylinder-head longitudinal side opposite the cylinder-head side on the side of the cooling-air duct housing. A fresh-gas line 16 and an exhaust manifold 17 are configured on this cylinder-head longitudinal side. In the region above, between and below fresh-gas line 16 and exhaust manifold 17, a significant portion of the cooling air delivered by cooling-air blower 9 flows back into the ambient environment again.

Figure 2:
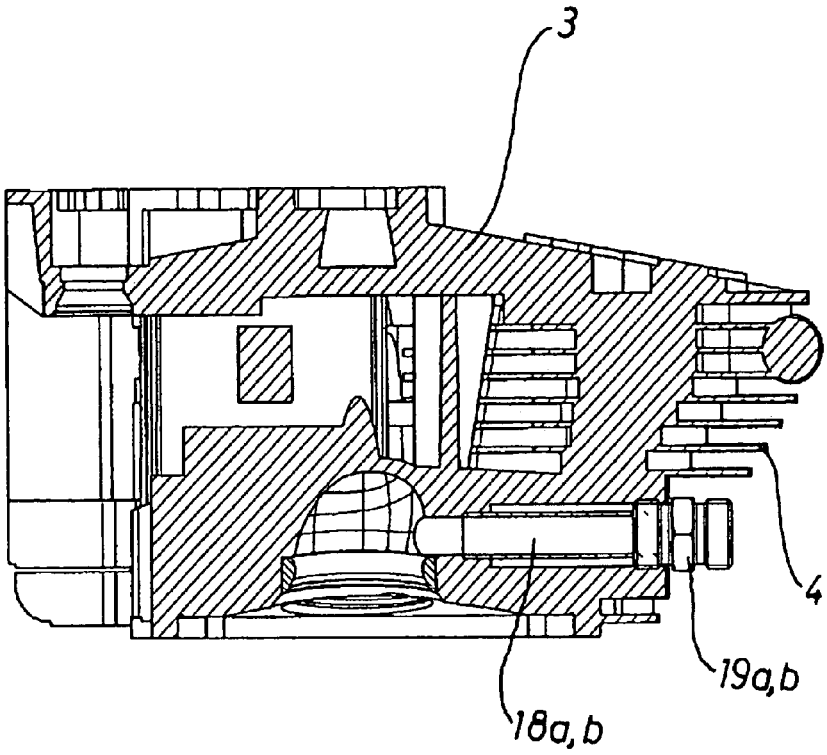
FIG. 2 depicts a cross section through a cylinder head in accordance with FIG. 1, in the area of a channel.

The combustion chambers located in the cylinders between individual cylinder heads 3 and the vertically reciprocating pistons in the respective cylinders, are each in fluid communication via gas-exchange valves and gas-exchange channels with fresh-gas line 16 and exhaust manifold 17. On the opposite cylinder-head side, channels 18*a*, 18*b* (FIG. 2) are incorporated into cylinder heads 3. In a side-by-side configuration, one channel 18*a* communicates with a gas-exchange exhaust port and channel 18*b* with a gas-exchange intake port. These channels 18*a*, 18*b* extend in a lower region of cylinder head 3 to the cylinder head side on the cooling-air blower side and are provided with mating coupling devices 19*a*, 19*b*.

An exhaust-gas recirculation system, which connects channels 18*a* to channels 18*b* in a controllable or adjustable manner, is configured in cooling-air duct housing 10. To that end, channels 18*a* are interconnected with a common manifold 20 which extends in the area of output end 11 via an elbow 21 into a feed pipe 22 to exhaust-gas recirculation control valve 23. Connected to exhaust-gas recirculation control valve 23 on the side opposite feed pipe 22 is a deflector elbow 24 which leads into a distribution line 25 that is configured approximately in parallel below manifold 20 and is connected, in turn, to channels 18*b* of individual cylinder heads 3.

The entire exhaust-gas recirculation system is located within cooling-air duct housing 10. On the one hand, therefore, it is not visible from the outside when cooling-air duct housing is closed, and, on the other hand, it does not affect the outer dimensions of the internal combustion engine. In addition, by configuring the exhaust-gas recirculation device completely inside of cooling-air duct housing 10, an effective cooling of the components of the exhaust-gas recirculation system is achieved. The individual pipes and elbows, as well as the exhaust-gas recirculation-control valve housing may also be additionally provided with inner and/or outer cooling ribs to enhance the transfer of heat.

In-line injection pump 12 is equipped with a governor that is designed as a mechanical governor. To facilitate actuation of exhaust-gas recirculation control valve 23 without the use of a complicated and expensive electronic control device, the position of a control rod provided in in-line injection pump 12 is picked off in a contactless manner, and this position is utilized for controlling exhaust-gas recirculation control valve 23 via a mechanical or electrical transmitting device.

To this end, an electrical control analyzes a control-rod displacement signal. In this context, a Hall-effect sensor is preferably used, which is switched via one or more magnets integrated in the control rod. A Hall-effect sensor of this kind is a very reliable electrical switch which may be used for switching the exhaust-gas recirculation on and off. In another embodiment of the present invention, the exhaust-gas recirculation is switched off above an injected fuel quantity that corresponds to a load greater than three fourths of the full load. In this full-load range, no exhaust gas is recirculated, since an exhaust-gas recirculation carried out in the full-load range would lead to a degradation of the exhaust emissions. To this end, one preferred specific embodiment provides for a plurality of small magnets to be inserted side-by-side in bores, in the region of the control rod that covers this injected fuel-quantity range. These magnets switch the Hall-effect sensor that is mounted on the exterior of the pump housing of the injector. This method, respectively this embodiment, is extremely reliable, since this electrical control, in particular, is not an electronic control device.

In a further embodiment of the present invention, the exhaust-gas recirculation is switched off at a speed below an elevated idling speed. This switching function is provided when, in response to decreasing speeds, for example to speeds below a threshold of 1500 rpm, there is the risk of smoke problems occurring during an exhaust-gas recirculation, due to the design of the injection system. For that reason, an inductive tachymetric switch is provided, which is likewise installed on the pump housing and emits the appropriate switch signal, in particular below a speed of 1450 rpm.

What is claimed is:

1. An internal combustion engine comprising:

a crankcase having a cylinder; and a cylinder head which covers the cylinder and having a fresh-gas channel and an exhaust-gas channel recessed therein that open out on a longitudinal side of the cylinder head and that communicate with a fresh-gas line and an exhaust manifold, respectively, an exhaust-gas recirculation system including an exhaust-gas recirculation line and a control valve, the exhaust-gas recirculation system being located on a cylinder head side opposite the fresh-gas line and the exhaust manifold, the exhaust-gas recirculation system having an inner and an outer ribbing.

2. An internal combustion engine comprising:

a crankcase having a cylinder;

a cylinder head which covers the cylinder and having a fresh-gas channel and an exhaust-gas channel recessed therein that open out on a longitudinal side of the cylinder head and that communicate with a fresh-gas line and an exhaust manifold, respectively, an exhaust-gas recirculation system including an exhaust-gas recirculation line and a control valve, the exhaust-gas recirculation system being located on a cylinder head side opposite the fresh-gas line and the exhaust manifold; and a cooling-air blower, the exhaust-gas recirculation system being configured directly in the cooling-air flow supplied by the cooling-air blower within a cooling-air duct housing.

3. The internal combustion engine as recited in claim 2 wherein channels opening out on the cylinder head side communicate with the fresh-gas channel and the exhaust-gas channel, and are recessed in the cylinder head.

4. The internal combustion engine as recited in claim 2 wherein the exhaust-gas recirculation control valve is disposed adjacently to the cooling-air blower.

5. The internal combustion engine as recited in claim 2 wherein the exhaust-gas recirculation system has an inner and an outer ribbing.

* * * * *